United States Patent [19]

Zurga

[11] 4,369,594

[45] Jan. 25, 1983

[54] MAGAZINE FOR MUZZLE LOADER

[76] Inventor: Joe F. Zurga, Rte. 8, Box 44, Harrison, Ark. 72601

[21] Appl. No.: 199,302

[22] Filed: Oct. 21, 1980

[51] Int. Cl.[3] ..... F41C 27/00

[52] U.S. Cl. ..... 42/90

[58] Field of Search ..... 42/90

[56] References Cited

U.S. PATENT DOCUMENTS

| | | | |
|---|---|---|---|
| 4,094,098 | 6/1978 | Gourley | 42/90 |
| 4,112,606 | 9/1978 | Griffin | 42/90 |
| 4,123,868 | 11/1978 | Wilson | 42/90 |
| 4,152,858 | 5/1979 | Dobbs | 42/90 |

*Primary Examiner*—Charles T. Jordan
*Attorney, Agent, or Firm*—Harvey B. Jacobson

[57] ABSTRACT

A horizontally elongated body is provided including a top face, a bottom face and a vertical dimension. A downwardly opening recess is formed in the bottom face and a plurality of laterally spaced, upstanding and cylindrical shot bores are formed in the body and open upwardly through the top face and downwardly into the recess spaced from adjacent peripheral portions thereof. A plurality of patch embraced shot balls are frictionally downwardly wedged in the shot bores and are displacable axially therethrough. The lower portions of the shot balls and the patch portions thereover project at least significantly downwardly into the recess and serve as locator portions for and are projectable into the muzzle end of a gun barrel bore whose muzzle is displaced upwardly into the recess, the downwardly projecting portions of the shot balls thereby serving to align the barrel bore with a shot bore and the patch embraced shot ball disposed therein for projection of the patch embraced shot ball from the lower end of corresponding shot bore directly into the barrel bore.

7 Claims, 4 Drawing Figures

MAGAZINE FOR MUZZLE LOADER

BACKGROUND OF THE INVENTION

Various forms of magazines and other types of semi-automatic loading devices for muzzle loader weapons heretofore have been provided such as those disclosed in U.S. Pat. Nos. 163,404, 4,094,098 and 4,152,858.

U.S. Pat. No. 4,094,098 discloses structure which closely parallels the structure of the instant invention, but which relies upon downwardly opening recesses in which to snuggly receive the muzzle of a muzzle loader weapon for proper positioning of the muzzle end of the weapon for reception of a patch embraced shot ball from the patented loading block or magazine. While this construction functions effectively when used in conjunction with muzzle loader weapons having muzzle barrel ends of precisely the correct outside diameter, when the loading block of U.S. Pat. No. 4,094,098 is utilized in conjunction with muzzle ends which are excessive in diametric dimension or less than the predetermined diametric dimention, the patented loading block or magazine does not function as intended. Accordingly, inasmuch as muzzle loader weapons include barrel muzzle ends which are of various different diametric dimensions, a need exists for a muzzle loading block or magazine which may be utilized in conjunction with muzzle loader weapons having different muzzle end diametric dimensions.

BRIEF DESCRIPTION OF THE INVENTION

The muzzle loading block or magazine of the instant invention is constructed in a manner whereby a plurality of patch embraced shot balls may be supported within body bores of diametric dimensions enabling the patch embraced shot balls to be frictionally held in predetermined positions within the body bores. One set of ends of the body bores open into an outwardly opening recess formed in the associated body in which the muzzle end of a muzzle loader may be inserted, independently of a specific diametric dimension of the muzzle end and the patch embraced slot balls project slightly from the lower ends of the body bores into the recess thereby enabling the downwardly projecting portions of the shot balls to function as keying elements for proper positioning of an associated muzzle end in alignment with a selected body shot bore. The downwardly projecting portions of the patch embraced shot balls are downwardly receivable in the muzzle end of the bore of a muzzle loader to accomplish the keying function and thereafter it is merely necessary to downwardly project the patch embraced shot ball from the body shot bore directly into the muzzle bore of an associated muzzle bore having been previously keyed to that shot ball.

The main object of this invention is to provide a loading block or magazine whereby a patch embraced shot ball may be quickly and successively loaded into the muzzle end of a muzzle loader weapon.

Another object of this invention is to provide a loading block or magazine for shot balls with which different diameter muzzle ends of muzzle loaders may be readily operatively associated preparatory to projecting a patch embraced shot ball from the loading block or magazine into the muzzle end of the bore of an associated muzzle loader.

Yet another important object of this invention is to provide a loading block or magazine for a muzzle loader which may be utilized to conveniently store, preparatory to use, a plurality of patch embraced shot balls.

A further object of this invention is to provide a loading block or magazine for muzzle loader weapons which may be utilized in conjunction with different muzzle loader weapons of the same caliber.

A final object of this invention to be specifically enumerated herein is to provide a muzzle loader block or magazine in accordance with the preceding objects and which will conform to conventional forms of manufacture, be of simple construction and easy to use as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
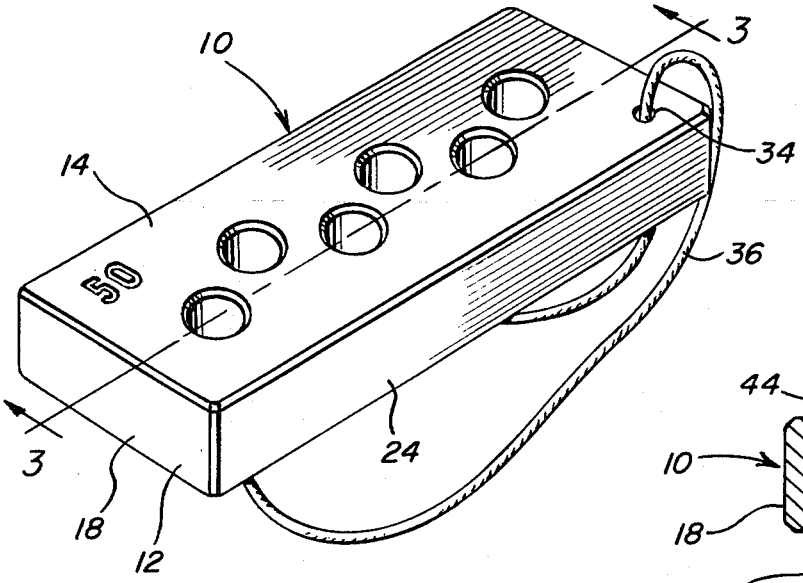
FIG. 1 is a perspective view of the magazine of the instant invention.

Referring now more specifically to the drawings, the numeral 10 generally designates the magazine of the instant invention. The magazine 10 comprises an elongated horizontal block 12 having top and bottom surfaces 14 and 16, opposite end surfaces 18 and 20 and opposite side surfaces 22 and 24.

The body 12 additionally includes a downwardly opening recess 26 formed in its bottom surface 16 and a plurality of vertical bores 28 are formed through the body 12 and include chamfered upper and lower ends 30 and 32 opening upwardly through the upper or top surface 14 and downwardly into the recess 26.

One corner portion of the body 18 is provided with a small diameter vertical bore 34 through which a lanyard 36 is secured and the bores 28 are arranged in a plan pattern including marginal portions spaced outwardly of adjacent bores 28. The marginal portions 38 of the recess 26 disposed outwardly of the outer peripheral portions of the bores 28 compries arcuate concave marginal portions 38 whose centers of curvature substantially coincide with the center axes of the adjacent bores 28.

In operation, a plurality of shot balls 42 embraced in patches 44 are downwardly displaced into the shot bores 28 formed in the block 12 from the upper chamfered ends 30 thereof. The balls 42 are downwardly displaced into the bores 28 until a significant lower end portion of each ball 42 projects into the recess 26, at least to the extent thereof illustrated in FIG. 4. The diameter of the shot bores 28 is such that the patch embraced shot balls 42 are tightly frictionally held in their adjusted positions in the bores 28. Thereafter, the body or magazine 28 may be conveniently carried by the lanyard 36 without danger of the shot balls 42 or the patches 44 becoming dislodged from the bores 28. Of course, those portions of the balls 42 which project into the recess 26 do not project beyond, and are thus shielded against accidental impact by an object with the bottom surface 16 of the body 12.

Figure 4:
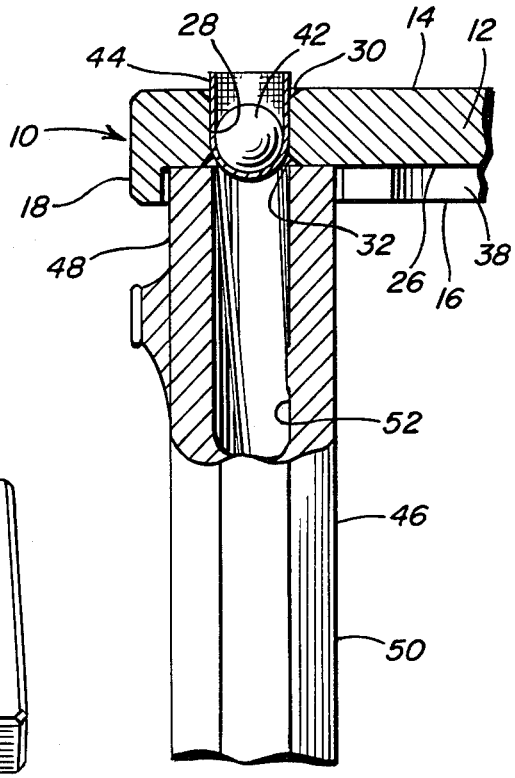
FIG. 4 is a fragmentary vertical sectional view illustrating the manner in which the magazine of the instant invention may be utilized to properly key the magazine into proper indexed position relative to the muzzle end of a muzzle loader bore preparatory to projecting a patch embraced shot ball from the magazine directly into the muzzle loader bore.
Figure 2:
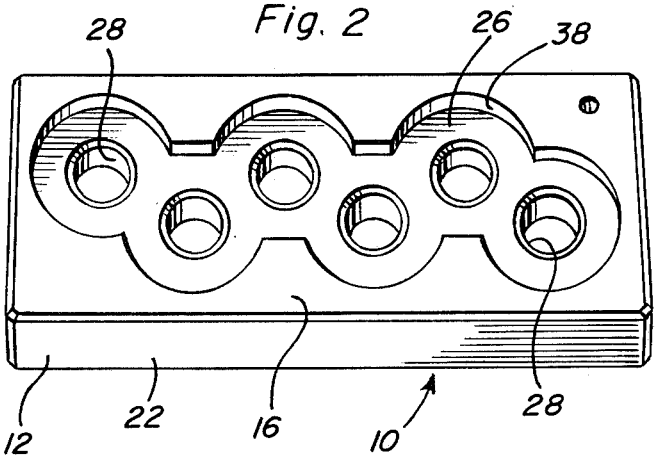
FIG. 2 is a further perspective view of the magazine as seen from the underside thereof.
Figure 3:
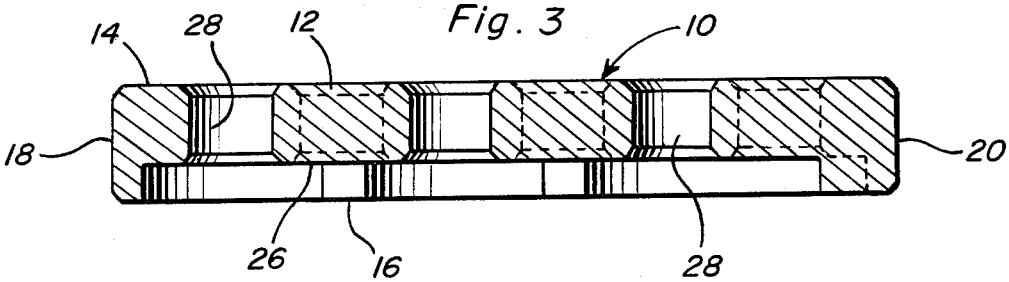
FIG. 3 is an enlarged vertical sectional view taken substantially upon the plan indicated by the section line 3—3 of FIG. 1.

Thereafter, when it is desired to load a muzzle loader weapon such as the weapon 46, the muzzle end 48 of the barrel 50 of the weapon 46 is upwardly displaced into the recess 26 in the manner illustrated in FIG. 4 of the drawings with the lower portion of a selected shot ball 42 projecting into the recess 26 being loosely received in the bore 52 of the barrel 50 at the muzzle end thereof. This "keying" of the ball 42 into the muzzle end of the bore 52 insures proper positioning of the muzzle end 48 of the barrel 50 within the recess 26 with the barrel bore 52 substantially registered with the corresponding shot bore 28. Thereafter, a suitable ramrod may be utilized to downwardly displace the shot ball 42 directly from the shot bore 28 into the barrel bore 52. Of course, before displacing the shot ball 42 down into the barrel 52, the barrel 52 must have a suitable quantity of powder placed therein.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A muzzle loading device for a muzzle loader gun, said device including a body having a top face, a bottom face and a vertical dimension, a downwardly opening recess formed in said bottom face, a plurality of laterally spaced upstanding and cylindrical shot bores formed in said body opening upwardly through said top face and downwardly into said recess spaced from the periphery thereof, a plurality of patch embraced slot balls frictionally wedged in said shot bores and displaceable axially therethrough, the lower portions of said shot balls and the embracing portions of said patches projecting at least significantly downwardly into said recess, those portions of said patch embraced shot balls projecting downwardly into said recess serving as locaters for and being losely receivable in the muzzle end of a gun barrel bore whose muzzle is displaced upwardly into said recess and thereby aligning said barrel bore with a shot bore and the patch embraced shot ball disposed therein for projection of said patch embraced shot ball from the lower end of the corresponding shot bore directly into the barrel bore.

2. The combination of claim 1 wherein the upper ends of said upstanding bores are chamfered.

3. The combination of claim 1 wherein said body top and bottom faces are substantially parallel, said recess defining a substantially plane or surface generally paralleling said top face.

4. The combination of claim 1 wherein said upstanding bores are disposed in a plan pattern of bores wholly within said recess and portions of the various marginal portions of said recess spaced outwardly of adjacent upstanding bores include concave arcuate portions whose centers of curvature substantially coincide with the center axes of the corresponding bores.

5. The combination of claim 4 wherein the upper ends of said upstanding bores are chamfered.

6. The combination of claim 5 wherein said body top and bottom faces are substantially parallel, said recess defining a substantially plane or surface generally paralleling said top face.

7. The method of positioning successive patch embraced shot balls for introduction into the muzzle end of the barrel bore of a muzzle loader weapon and subsequently effecting introduction of said shot balls into said barrel bore, said method comprising providing a body having a top face, a bottom face and a vertical dimension and including a downwardly opening recess formed in said bottom face and also having a plurality of laterally spaced, upstanding and cylindrical shot bores formed in the body opening upwardly through the top face thereof and downwardly into the recess spaced from the periphery thereof, frictionally inserting a plurality of patch embraced shot balls downwardly into said shot bores with the shot balls positioned in the lower ends of the shot bores and having the lower portions thereof projecting significantly downwardly from the shot bores and into the recess, and successively upwardly displacing the muzzle end of a muzzle loader weapon into the recess with the muzzle end of the bore of the weapon at least loosely embracingly receiving the lower portions of said balls therein whereby to "key" the muzzle end of the barrel bore of the weapon in alignment with successive shot bores, and downwardly displacing the patch embraced shot balls from said shot bores directly into the barrel bore of the muzzle loader.

* * * * *